US005748085A

United States Patent [19]

Davis et al.

[11] Patent Number: 5,748,085

[45] Date of Patent: May 5, 1998

[54] ELECTRONIC ARTICLE SURVEILLANCE EVENT MONITORING SYSTEM

[76] Inventors: Dennis W. Davis, 10740 Eland St., Boca Raton, Fla. 33428; John Lucio, 1212 Hidden Ridge #3049, Irving, Tex. 75038

[21] Appl. No.: 631,148

[22] Filed: Apr. 15, 1996

[51] Int. Cl.[6] ..... G08B 13/14

[52] U.S. Cl. ..... 340/572; 340/825.3; 340/539

[58] Field of Search ..... 340/572, 539, 340/506, 502, 825.06, 825.15, 825.34, 825.31; 235/385, 382, 380; 364/227.3; 395/228; 705/22, 28

[56] References Cited

U.S. PATENT DOCUMENTS 5,023,600 6/1991 Szklany et al. ..... 340/572
5,322,991 6/1994 Hanson ..... 235/472
5,467,082 11/1995 Sanderson ..... 340/825.31 X
5,600,304 2/1997 Accolla et al. ..... 340/572

*Primary Examiner*—Thomas Mullen

[57] ABSTRACT

A monitoring system for use with an electronic article surveillance (EAS) system is disclosed which is capable of recording alarm and other events associated with the operation of the EAS system. A preferred embodiment includes a monitor device having alarm detection capability, an alphanumeric keypad for event code entry by cognizant employee personnel, memory for storage of event data and employee identification, and means for downloading the data to a portable reader or a central processor. The monitoring system will allow store managers and electronic article surveillance manufacturers to audit the performance of installed EAS systems. Further it will provide store managers with a means of recording and thereby assessing whether store employees are responding appropriately to EAS events.

23 Claims, 6 Drawing Sheets

ELECTRONIC ARTICLE SURVEILLANCE EVENT MONITORING SYSTEM

BACKGROUND OF THE INVENTION

1. Field of the Invention

This invention relates to the monitoring of electronic article surveillance (EAS) systems. More specifically, this invention relates to a data storage and communication system for the recording and transmission of operational events associated with an electronic article surveillance system.

2. Description of the Prior Art

The present invention is an elaboration of the concepts discussed in Disclosure Document Number 393,631, filed Feb. 28, 1996 with the U.S. Patent and Trademark Office. This invention provides a means of determining the operational performance of EAS systems and assessing the performance of personnel responsible for these systems. EAS systems typically use electromagnetic energy to detect whether an article having an attached EAS tag has been taken past an electronic surveillance station. The electronic surveillance station emanates an electromagnetic field and can detect changes to this field induced by the presence of an active EAS tag. Conventional EAS tags typically contain nonlinear electronic or magnetic circuits that radiate harmonics of the incident electromagnetic field not otherwise present. These harmonics are detected by one or more receivers in the EAS surveillance station. Such systems have been used for many years to provide security in retail establishments wherein the EAS tags are attached to the individual items of inventory within a store. The tags can be removed or deactivated by sales personnel at the point of item purchase. Hence, EAS surveillance stations are placed at store entrances and exits to detect any pilferage. Upon detection of a tag moving through the area of a surveillance station, an alarm is activated. Such alarms include audible alarms and flashing lights that must be deactivated by the cognizant store personnel. U.S. Pat. No. 4,413,254 to Pinneo, et. al. provides a good summary of the technology underlying conventional EAS systems.

Conventional EAS systems are not foolproof and for various reasons are subject to missed detections and false alarms. These anomalous events may be dependent upon the nature of the products being tagged, the electromagnetic environment of the particular installation site (including the intended range of system coverage), or the circuitry of the particular EAS system. Missed detections directly impact a store's profit margin and can increase the temptation to steal. False alarms needlessly upset paying customers and undermine store employee confidence in the system. In fact, some employees may be tempted to ignore some alarms if the system comes to be regarded as inconsistent under certain circumstances. Store managers would like to know how well such EAS systems are functioning over time and whether the store's employees are responding appropriately to EAS system events. Additionally, manufacturers of these systems would benefit from the same information.

The need therefore arises for a means of recording the nature and circumstances of appropriate and anomalous EAS events. This will allow store managers and EAS manufacturers to audit the performance of installed EAS systems. Further it will provide store managers with a means of recording and thereby assessing whether store employees are responding appropriately to EAS events. In a preferred embodiment of the present invention, an EAS monitoring system provides an interface for a store employee to log the nature and circumstances of an EAS event. This data is stored for later recall or download to a central electronic archive or processing system. The interface can comprise an alphanumeric keypad for code entry and an associated visual feedback display. The identity of the attending employee can be entered by way of the keypad or even with a proximity reader that can read identification data stored in an employee badge, for instance. The stored data can then be electronically communicated to a central computer.

The prior art does not disclose an EAS system that provides means for recording the circumstances of EAS events. U.S. Pat. No. 4,573,042 to Boyd, et. al discloses an EAS system that uses in lieu of conventional EAS tags, small devices attachable to clothing or other items of inventory. These devices contain audio alarm means that are activated upon attempted pilferage. An associated apparatus is used to reset the alarm within these devices and includes a display for tallying the number of resets conducted.

In addition to art relating to EAS systems, the areas of prior art relevant to the present invention therefore include recording devices, display devices, proximity and optical readers, and communication systems.

Data Recording Devices

U.S. Pat. No. 5,185,700 to Bezos, et. al discloses a solid state event recorder for application to railroad locomotives. The device includes a plurality of interface modules for collecting various types of data over the period of several days. The data is stored in a memory module and can be downloaded and transmitted via a telemetry transmitter. U.S. Pat. No. 5,322,991 to Hanson discloses a hand-held radio frequency data terminal that includes a data display, and an alpha-numeric keyboard and bar code reader for manual data entry. An RS-232 interface is included as an option to the radio frequency transmission of stored data to a central computer. U.S. Pat. No. 5,256,908 to Averbuch, et. al. is a portable data logging device for recording data related to the identity and dimensions of rooms within a building. Incorporated into the unit is an electronic distance measuring device for determination of room dimensions. U.S. Pat. No. 5,166,499 to Holland, et. al. is a tour monitoring system that comprises a portable tour monitor and a central programming and report generating computer. The portable monitor unit includes a bar code reader, an alphanumeric display, and an alphanumeric keypad. The monitor is used to read codes at checkpoints along a tour and generates time stamped signals in response. The unit contains memory for preprogrammed checkpoint routes and can compare the identity of sensed checkpoints with stored checkpoints. This information can then be transmitted to a central computer.

Proximity and Optical Readers

A well-established technology is that of proximity readers. Such devices are used to exchange analog or digital information between an interrogator and a transponder. Typically, radio frequency means are used which allow such information exchange without physical contact between the interrogator and the transponder. In identification systems, a coded transponder is energized by radio frequency interrogation to produce a coded identification signal particular to the person or object carrying the transponder. Proximity readers are widely used in employee identification and access control. Quite often the employees carry badges having embedded transponding means. Recent U.S. Pat. No. 5,467,082 to Sanderson provides a good survey of prior art in this area.

Widely used optical data readers such as bar code readers and scanners can be used for the purpose of reading employee identification or other information into an EAS monitor. This technology is also well established in the prior art.

Communication Systems

There is a host of data communication modalities available offering different carrier and modulation formats. Carrier energy can take the form of radio frequency, optical and fiber optic, and acoustic (ultrasonic) signals. Data can be transferred using these forms of carrier energy with any number of analog and/or digital modulation schemes. Additionally, in the context of networking a number of monitoring devices and EAS systems, different communication network architectures such as stars or rings can be implemented which offer different connectivity characteristics.

SUMMARY OF THE INVENTION

The present invention comprises an electronic device that monitors and records alarm and other event activity of an EAS system. After an EAS system goes into alarm mode, the monitor will collect, store, and communicate data relating to the alarm and how it was responded to by the employees working in a store or other facility requiring inventory security. One embodiment of the invention requires input of an alarm-related signal from the EAS system or from a remote EAS alarm for the detection of an alarm condition. An alternative embodiment uses acoustic and/or optical sensors to remotely detect siren or flashing light alarms of the EAS system. Cognizant employees can interact with the monitor for control of the monitor and for input of event related data via a keypad interface. The monitor has internal memory for the recording of the alarm event as well as the interaction and responsiveness of the employees responsible for managing the given EAS system. The scope of the present invention includes EAS system monitors which are retrofit to existing EAS systems as well as monitors that are incorporated into the EAS system design and hence are part of an improved EAS system.

The following definitions serve to clarify the disclosed and claimed invention:

Markers refers to devices attached to inventory articles for the purpose of surveillance of such articles using an EAS system. Markers include labels, tags, and any other device designed to operate in concert with the EAS system for this purpose.

Article surveillance system detector units refers to the parts of an EAS system deployed near room entrances and exits for the purpose of detecting markers.

Transceiving data terminal refers to a portable means of data input, output and storage used for the purpose of interfacing with the EAS monitor to either upload or download information.

User interface means refers to means for an employee to enter data into or extract data from the EAS monitor.

Alarm signal sensing means refers to either a monitor input for the electrical signal from the EAS system indicative of an EAS alarm or sensors that detect the radiated energy from optical or siren alarms.

Event and data recording means refers to the electronics that accomplish the input, recall and output of information; this includes processor, data interface and memory functions.

Data communication means refers to provision for the establishment of a data link between the monitor and another electronic device for the uploading and downloading of electronic information.

Power supply means refers to the source of electrical power for the electronics contained within the monitor. This includes power derived from the EAS system, power supplies deriving power from the power line, or battery power supplies.

Electronic article surveillance system event refers to any event of predetermined significance related to the operation of the EAS system.

Responding to an electronic article surveillance system event by employee action refers to the response that should be taken by a store employee upon occurrence of an alarm or other EAS event.

Objects and Advantages

Several objects and advantages of the present invention are:

(a) to provide a monitoring system that can be used in concert with an EAS system for recording EAS events;

(b) to provide a monitoring system that can be used in concert with an EAS system for assessing the performance of the EAS system;

(c) to provide a monitoring system that can be used in concert with an EAS system for assessing the performance of the cognizant employee staff in dealing with EAS events;

(d) to provide an EAS system monitoring device that can be easily retrofitted to an EAS system;

(e) to augment the information available from an EAS system in a cost effective manner;

(f) to provide an EAS system monitoring device that can be easily retrofitted to an EAS system;

(g) to provide an enhanced EAS system which includes a self-monitoring capability.

BRIEF DESCRIPTION OF THE DRAWINGS

In the drawings, closely related figures have the same number but different alphabetic suffixes.

DETAILED DESCRIPTION OF THE INVENTION

Figure 1:
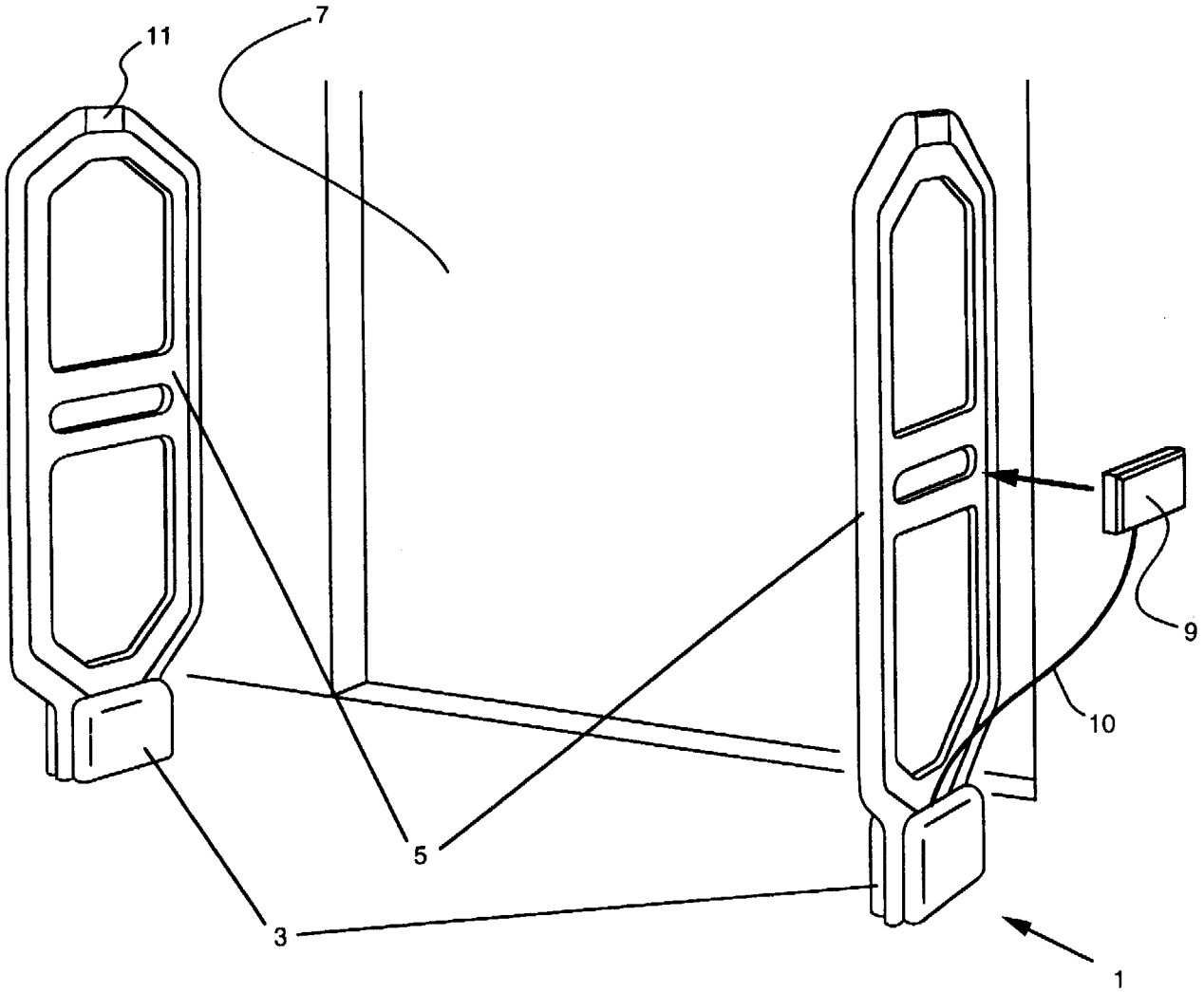
FIG. 1 is a pictorial diagram of the sensing pedestals of a conventional EAS system showing the placement of the monitoring device.

FIG. 1 depicts the use of the present monitor invention with a typical conventional EAS system 1. The antennacontaining pedestals 5 of the EAS system are shown placed on either side of a store exit 7 so as to detect any pilferage attempted via this exit. In this example system, detection and alarm generating electronics are housed within enclosures 3 located at the base of the pedestals. The electronics provides an alarm signal that activates flashing lights 11 at the top of the pedestals 5 as well as an audible siren alarm not shown, but usually located on an adjacent wall. The present invention is used to record alarm and other operational events associated with the EAS system. An embodiment of the monitor comprising an electronics module 9 is shown attachable to one of the pedestals 5 and connected to the EAS system electronics within an enclosure 3 by means of an electrical cable 10. The monitor would record in its internal memory the EAS alarm as well as the responsiveness of the employees responsible for implementing and managing the EAS system. This information can be downloaded to a central processing or record keeping station in various ways to be described below.

Figure 2:
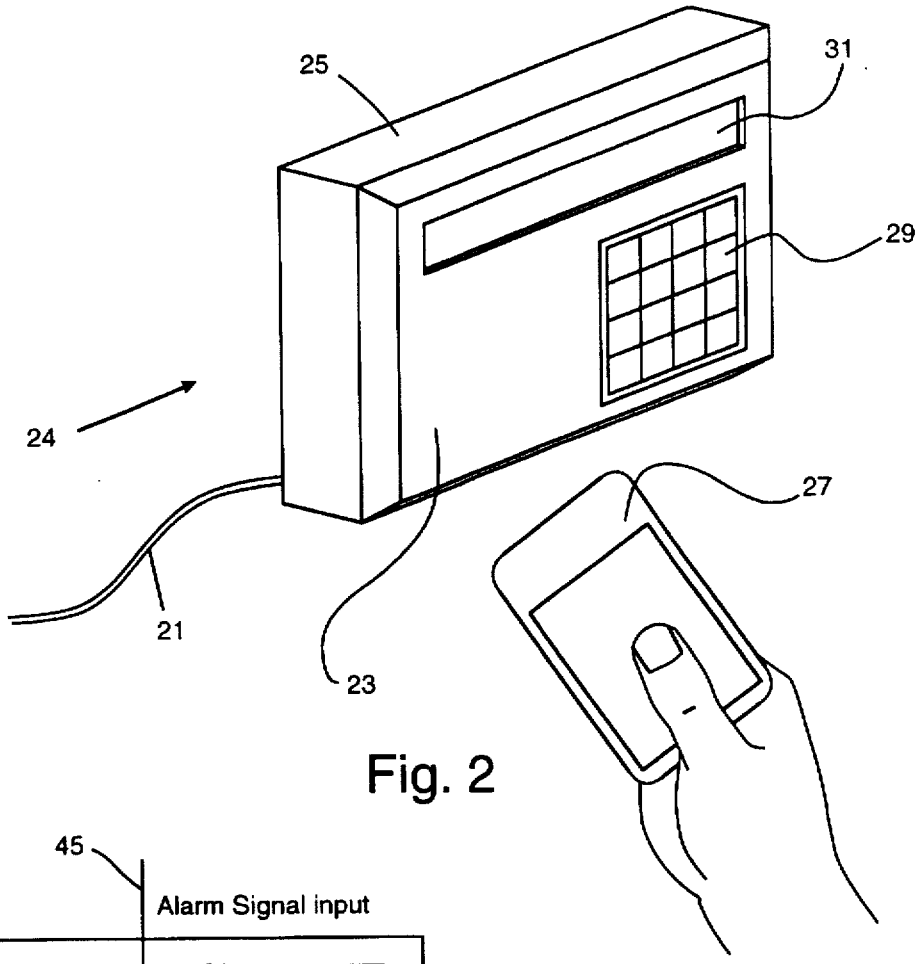
FIG. 2 is a pictorial diagram of an embodiment of the monitoring device featuring keypad interface and proximity reader.

FIG. 2 provides an expanded view of the monitor 24 depicted in FIG. 1. The monitor enclosure 25 contains memory and interface electronics for receiving and storing alarm information from the EAS system via electrical connection 21 and event code and employee data entered by an employee using keypad 29. The contained electronics also provides for the prompting and echoing of keypad entries by way of an LCD or LED display 31. An option depicted in FIG. 2 is a proximity badge reader contained within the region 23 of the monitor that identifies an employee upon presentation of their access badge 27 to the monitor.

In an operational scenario the monitor would go into alarm mode when the EAS system does. An employee would need to respond to an EAS alarm within a predetermined amount of time by presenting their access badge to the monitor or by manual entry of their employee number and pass code using the keypad 29. The monitor would request that the employee key in the event code that represents the reason the EAS system went into alarm. A candidate list of such reasons includes:

Failure to remove or deactivate an EAS tag or label

Apprehension of a shoplifter

Customer fled scene after alarm

False alarm - induced by customer presence

False alarm - no one present near EAS system

False alarm - EAS tags displayed to close to EAS system

Unattended alarm

Testing EAS system

Servicing system

The monitor would then log the time the alarm occurred, the identity of the employee who responded to the alarm, the alarm event code logged by the employee, and the time it took for the employee to respond to the alarm. This information can then be downloaded via an ethernet or phone port to the facility local area network, point of sale system, dedicated phone line or into a portable laptop computer or handheld data terminal. The data obtained from the monitor could be gathered at a central processing location determined by the system user and put into a custom developed software package to create reports on EAS system events. Following is an example list of the type of ancillary information that could be provided by the monitor:

Number of EAS alarms in a given period

Number of EAS alarms not properly attended

Time for an employee to respond to an alarm

Time of the alarm

Period of time since last alarm

Period of time since system was last tested

Period of time since system was last serviced

Number of service calls in a given period

Merchandise and dollar amount recovered in an apprehension

Figure 3:
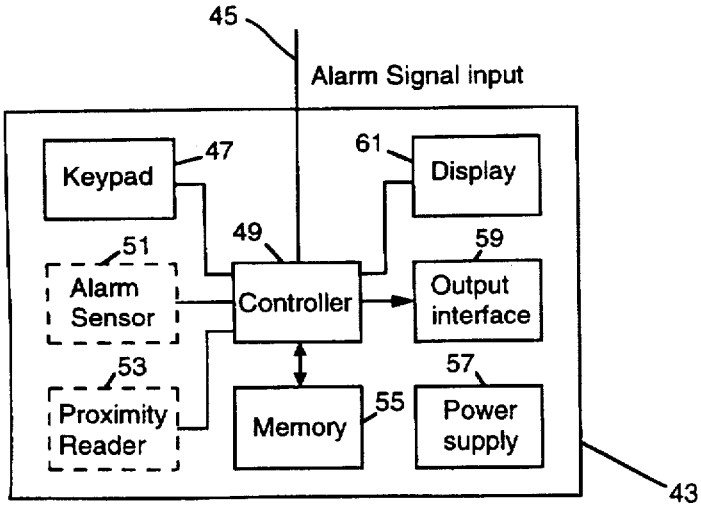
FIG. 3 is a functional block diagram of the components comprising the monitoring device.

A functional block diagram showing the various components of the monitor 43 is given in FIG. 3. The controller 49 can comprise a microprocessor, a microcontroller, or a read only memory (ROM) or programmable array logic (PAL) driven state machine. The controller 49 executes the desired monitor functions of recording alarm and employee data and executing the user interface protocol. More specifically, the controller receives an alarm signal either by direct electrical connection 45 with the EAS system or alternatively by standoff sensing of the EAS alarm with an alarm sensor 51 depicted with dashed lines. As will be discussed below, such a sensor would detect optically or acoustically radiated alarm energy from the EAS system. The controller 49 then reads data entered from the keypad 47 or the optional proximity reader 53. Event codes, times of event occurrence, employee identification, and related data are stored in and retrieved from memory 55 by controller 49. The controller 49 outputs to display 61 keypad entries and prompting information. The output interface 59 essentially allows download of stored monitor data to another computer or data storage platform and can take the form of a serial or parallel digital interface. The power supply 57 represents a source of electrical power that can either be derived from the EAS system power supply or can be a totally separate line derived supply. It can also take the form of a battery-based power supply.

Figure 4A:
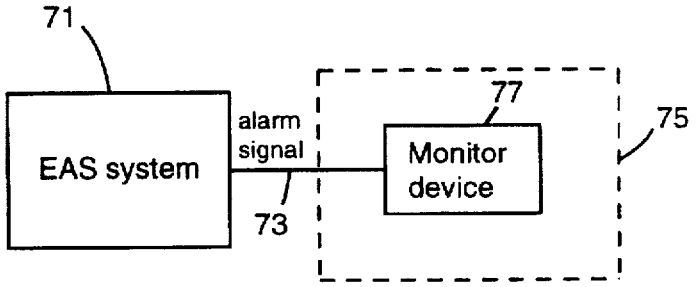
FIG. 4 is a block diagram depiction of the various ways in which the monitoring system can receive an alarm signal from the EAS system.
Figure 4B:
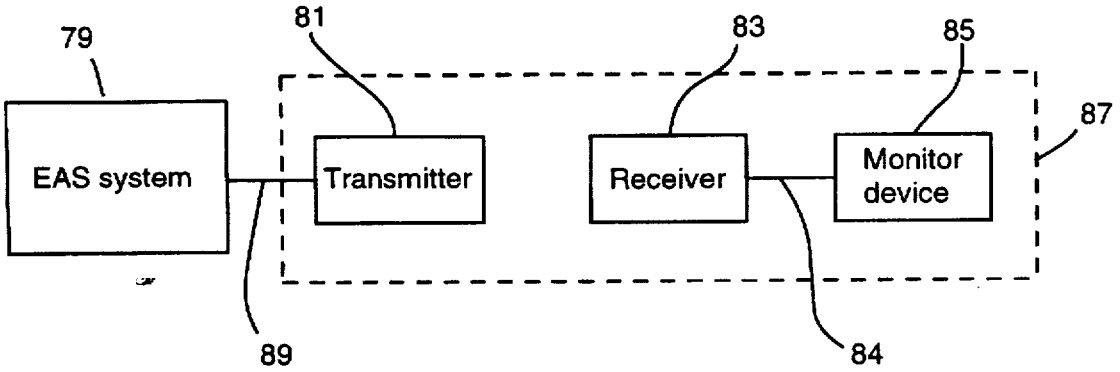
Figure 4C:
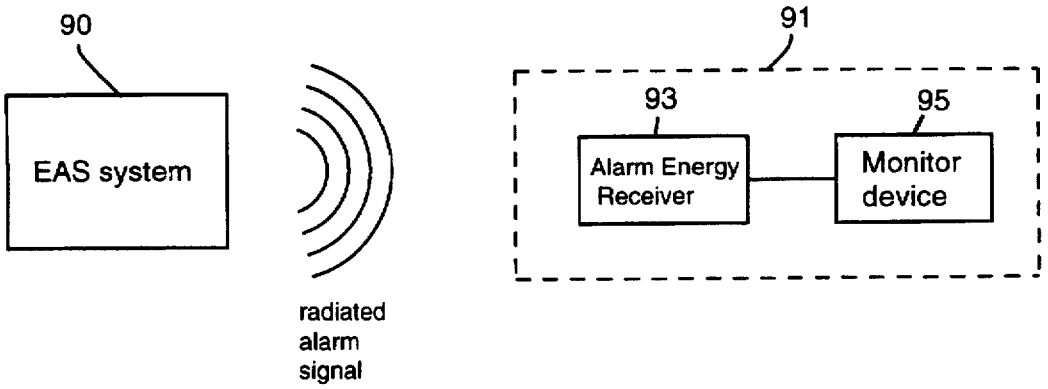

FIGS. 4*a*, *b*, and *c* depict in functional block diagram form the various embodiments of the monitor interface with the EAS system. In FIG. 4*a*, the EAS system 71 provides the alarm signal to the monitor system 75 by a direct electrical or fiber optical connection 73. In this embodiment, the monitor system denoted by the dotted box simply comprises the monitor device depicted in FIG. 1. In FIG. 4*b*, the alarm signal is communicated from the EAS system 79 to monitor device 85 by a combination of transmitter 81 and receiver 83. The alarm signal is input to transmitter 81 by electrical connection 89. The transmitter 81 transmits the alarm signal information to receiver 83 that provides the alarm signal to the monitor device 85 by electrical or fiber optical connection 84. The transmitter/receiver types envisioned include optical, ultrasonic, or radio frequency. Radio frequency devices that transmit and receive modulated radio frequency carrier energy are preferred because they provide a robust communication link. The monitor system 87 in this embodiment then comprises the transmitter 81, the receiver 83, and the monitor device 85. In lieu of using an electrical alarm signal directly as in FIG. 4*a* or by telemetry as in FIG. 4*b*, the energy radiated by the EAS alarm system can be detected. This is depicted in FIG. 4*c*. The alarm of EAS system 90 comprises flashing lights and/or an audible siren alarm. Hence, optical and/or acoustic radiation fields are emanated from the EAS system 90. In the case of the flashing strobe lights, the intensity, pulse repetition frequency and wavelength can be used to preferentially detect the alarm condition over background light using photodetectors. Likewise, in the case of the siren alarm, the character of the alarm can allow preferential detection of the alarm over the acoustic background using an acoustic detector such as a microphone. In the embodiment of FIG. 4*c*, the monitor system 91 comprises the alarm energy receiver (detector) 93 and the monitor device 95. Alarm energy receiver 93 represents either optical, acoustic or combination sensing.

Figure 5:
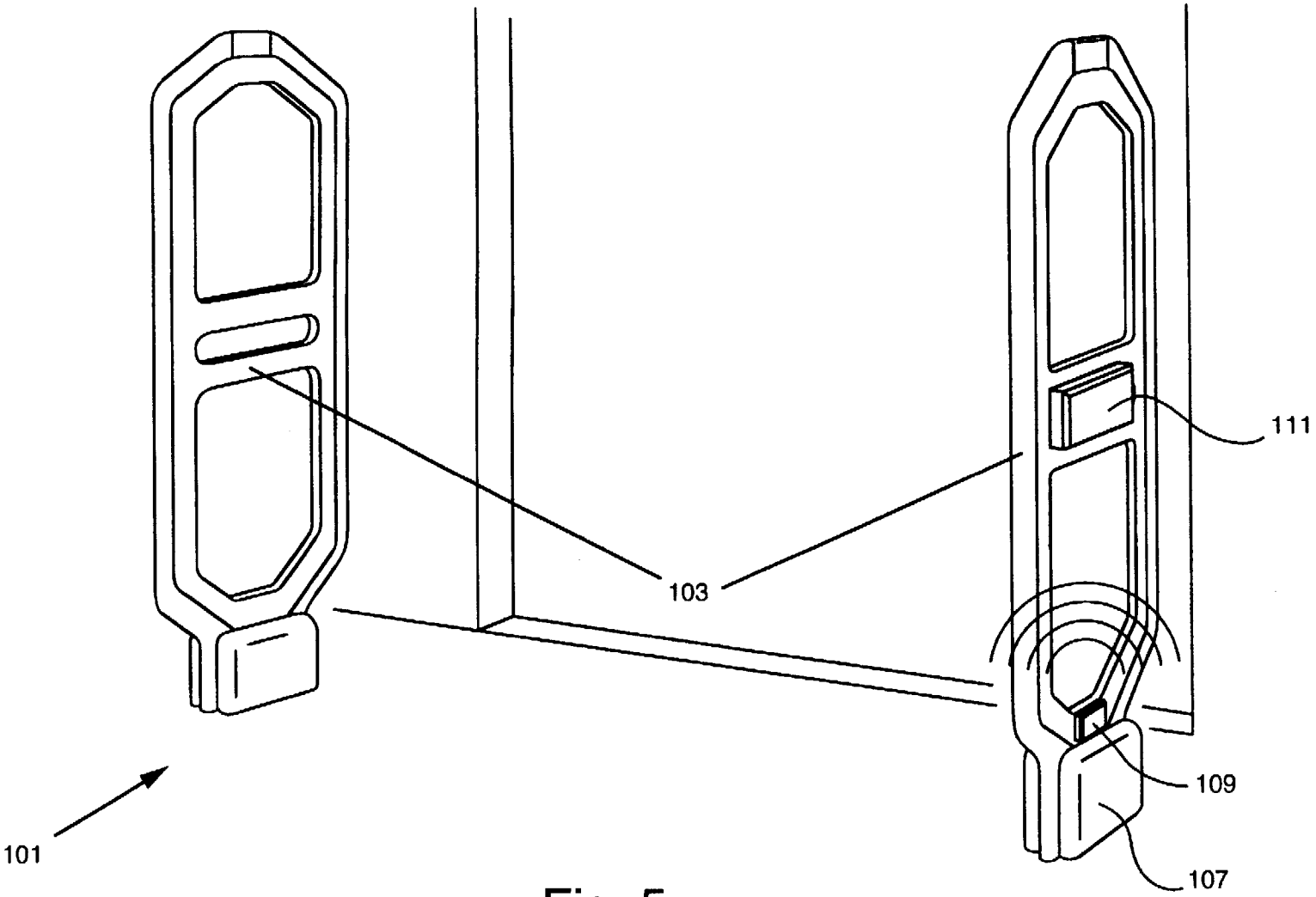
FIG. 5 is pictorial diagram of a monitoring system which includes an alarm signal transmitter and receiver.

FIG. 5 depicts the use of a radio frequency link between the EAS system and the monitor as in FIG. 4*b*. An EAS system 101 is shown with a monitor device 111 attached to one of the EAS pedestals 103. Contained within the monitor device enclosure is a receiver that detects the alarm signal radiated by transmitter 109. The transmitter 109 is connected to EAS system electronics within enclosure 107 by either electrical or fiber optical means.

Figure 6:
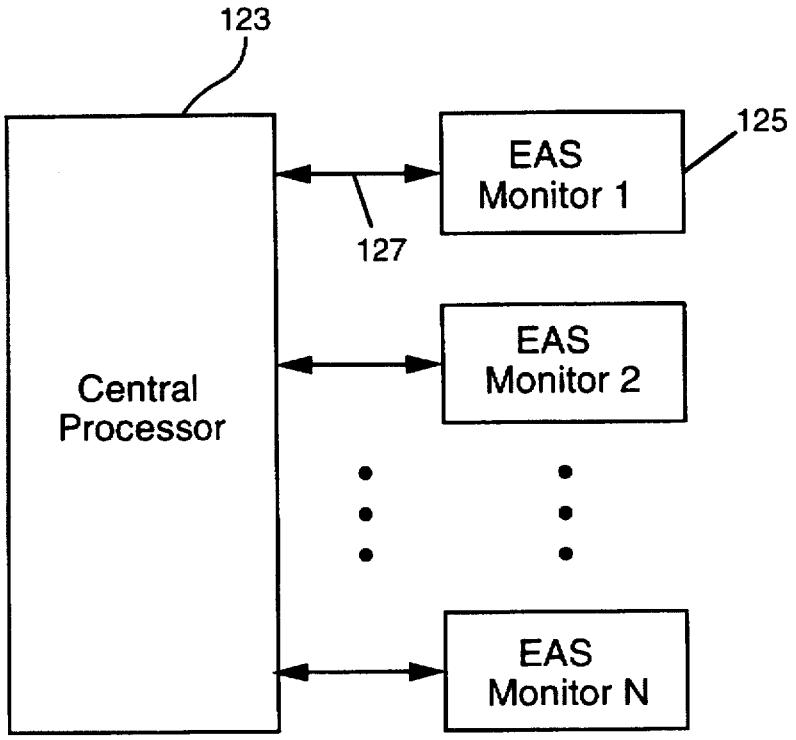
FIG. 6 is a functional block diagram of a networked system of monitoring devices.

The networking of multiple EAS system monitors is depicted in FIG. 6. The output interface of each monitor 125 is shown having a communication link 127 with a central processor 123. The output interface in its most general form is bi-directional allowing each monitor not only to download information to the central processor 123 but to upload such information as changes to its operational protocol, time verification, etc. The communication link 127 can comprise electrical connections, fiber optical connections or radio frequency interconnects. The central processor 123 logs the data downloaded from each monitor 125 and tabulates this data in reporting format.

Figure 7:
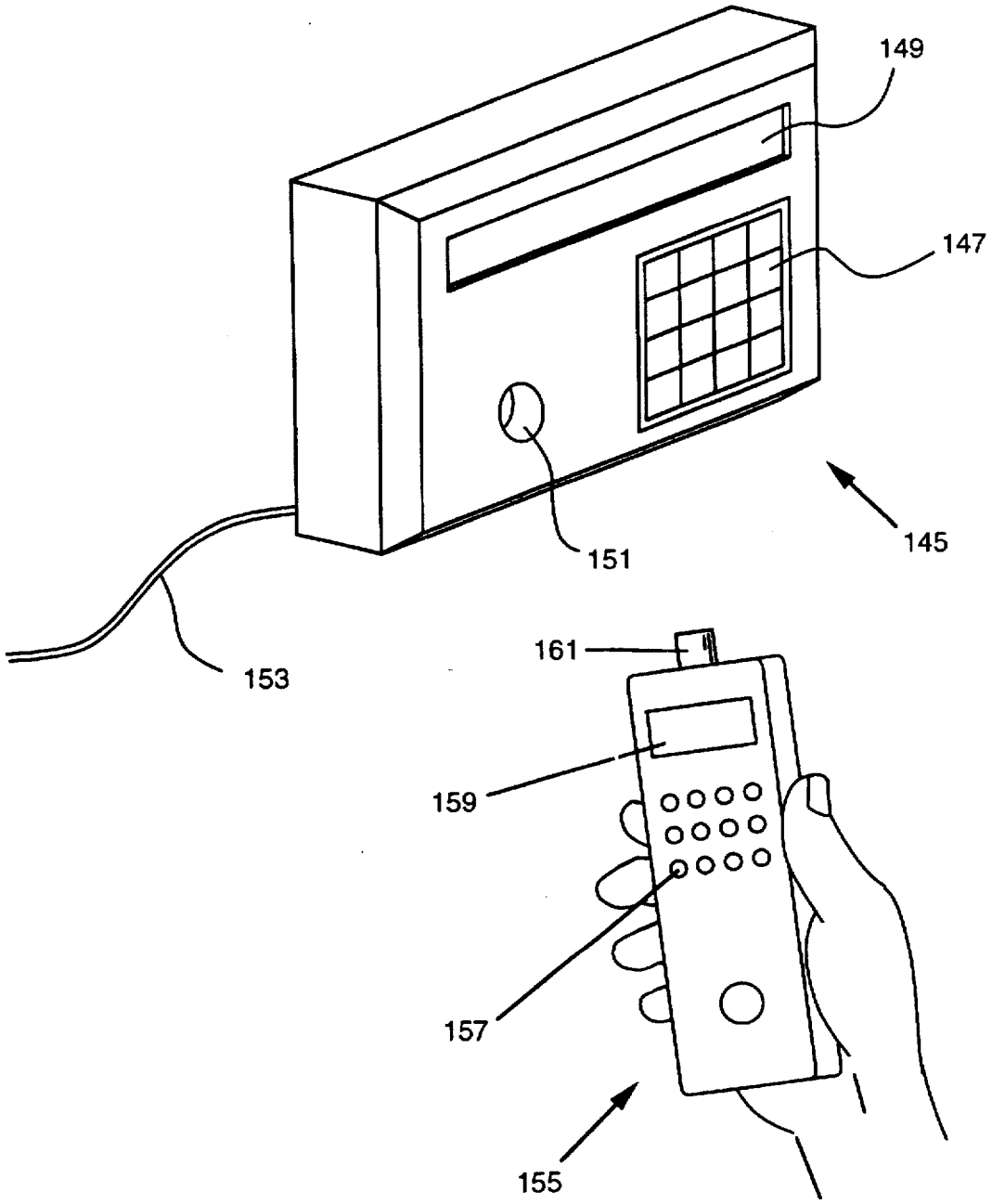
FIG. 7 is pictorial diagram of a monitoring device with an associated portable data transceiver for control of monitoring device and download of information stored in the monitoring device.

A monitor 145 that is usable with a handheld transceiving data terminal 155 is shown in FIG. 7. The monitor 145 is shown with previously described alarm connection 153 to the EAS system, keypad 147, and display 149. The monitor 145 can also include a transceiver for communication with a handheld data transceiving terminal 155. The monitor transceiver, not shown but internal to monitor 145, is connected to the data port receptacle 151." The data port receptacle 151 is depicted as an implementation of an optical serial port. Data is exchanged over an infrared link established between sensing probe 161 and optical port receptacle when the sensing probe 161 is placed within the optical port receptacle 151. Other means of data exchange between monitor and terminal can be envisioned and include radio frequency and ultrasonic transmission as well as electrical contact. Manual entry of data into the handheld transceiving data terminal 155 is accomplished with keys 157 and data is displayed on display 159. The handheld transceiving data terminal 155 can be used to interrogate the monitor, store downloaded data, and upload data to both monitor and central processing stations.

What is claimed is:

1. A monitoring system for use with an electronic article surveillance system, said monitoring system comprising at least one monitoring device further comprising:

a) user interface means;

b) alarm signal sensing means;

c) event and data recording means;

d) data communication means; and e) power supply means, said user interface means allowing the entry into said monitoring system of event related information associated with the operation of said electronic article surveillance system, said alarm signal sensing means allowing said monitoring system to record an alarm event, said event and data recording means providing for the retrievable storage of said event related information and times of event occurrences, said data communication means providing for the downloading of said stored event related information, said power supply means providing electrical power for the operation of said monitoring system.

2. A monitoring system as claimed in claim 1, wherein said monitoring system includes data communication networking means and computer processing means receiving data from a plurality of said monitoring devices associated with a corresponding plurality of said electronic article surveillance system detector units, processing said data so as to provide an indication of the performance of said plurality of electronic surveillance system detector units.

3. A monitoring system as claimed in claim 2, wherein said monitoring devices are capable of responding to commands from said computer processing means, said commands causing changes in the operation of said monitoring devices.

4. A monitoring system as claimed in claim 2, wherein said communication networking means comprises electrical circuit connections.

5. A monitoring system as claimed in claim 2, wherein said communication networking means comprises radio frequency data links.

6. A monitoring system as claimed in claim 2, wherein said communication networking means comprises fiber optical links.

7. A monitoring system as claimed in claim 1, wherein said alarm signal sensing means comprises an electrical output signal from said electronic article surveillance system detector unit which is indicative of an alarm condition and said power supply means comprises electrical power delivered to said monitor system by said electronic article surveillance system.

8. A monitoring system as claimed in claim 7, wherein said user interface means comprises a keypad.

9. A monitoring system as claimed in claim 8, which includes a proximity reader within each said monitoring device.

10. A monitoring system as claimed in claim 7, wherein each said monitoring device further includes a data transceiver and said monitoring system includes at least one transceiving data terminal, said transceiving data terminal usable for the control of each said monitoring device and the downloading of information stored in each said monitoring device.

11. A monitoring system as claimed in claim 10, wherein said data transceivers and said transceiving data terminal communicate by means of radio frequency energy.

12. A monitoring system as claimed in claim 10, wherein said data transceivers and said transceiving data terminal communicate by means of optical energy.

13. A monitoring system as claimed in claim 1, wherein said alarm signal sensing means comprises an alarm sensor taken from the group comprising acoustic and optical sensors, said alarm sensor capable of detecting radiated alarm energy given off by said electronic article surveillance system upon activation of said alarm, and said power supply means comprising a battery power supply.

14. A monitoring system as claimed in claim 13, wherein said user interface means comprises a keypad.

15. A monitoring system as claimed in claim 14, which includes a proximity reader within each said monitoring device.

16. A monitoring system as claimed in claim 13, wherein each said monitoring device further includes a data transceiver and said monitoring system includes at least one transceiving data terminal, said transceiving data terminal capable of communication with each said transceiver for the control of each said monitoring device and the downloading of information stored in each said monitoring device.

17. A monitoring system as claimed in claim 16, wherein said data transceivers and said transceiving data terminal communicate by means of radio frequency energy.

18. A monitoring system as claimed in claim 16, wherein said data transceivers and said transceiving data terminal communicate by means of optical energy.

19. A monitoring system as claimed in claim 1, wherein said alarm signal sensing means comprises:

a) a transmitter having as input, the electrical alarm output of said electronic article surveillance system; and b) a receiver providing input to said event and data recording means, said transmitter transmitting said alarm output to said receiver, said power supply means comprising electrical power connection from said electronic article surveillance system to said transmitter and a battery power supply powering said receiver and said monitor device.

20. A monitoring system as claimed in claim 19, wherein said transmitter transmits said alarm signal over a radio frequency carrier.

21. A monitoring system as claimed in claim 19, wherein said transmitter transmits said alarm signal over an optical carrier.

22. In an electronic article surveillance system of the type which uses electromagnetic fields to detect the presence of article attached markers for surveillance of said articles, the improvement comprising:

a monitoring system that comprises at least one monitoring device further comprising:

a) user interface means;

b) alarm signal sensing means;

c) event and data recording means;

d) data communication means; and e) power supply means, said user interface means allowing the entry into said monitoring system of event related information associated with the operation of said electronic article surveillance system, said alarm signal sensing means allowing said monitoring system to record an alarm event, said event and data recording means providing for the retrievable storage of said event related information and times of event occurrences, said data communication means providing for the downloading of said stored event related information, said power supply means providing electrical power for the operation of said monitoring system.

23. A method of assessing the performance of an electronic article surveillance system comprising the steps of:

(a) detecting an electronic article surveillance system event;

(b) responding to said electronic article surveillance system event by employee action;

(c) storing electronic article surveillance system event related information;

(d) downloading said stored electronic article surveillance system event related information to a central recording facility.

* * * * *